US010588376B1

(12) United States Patent
Li et al.

(10) Patent No.: US 10,588,376 B1
(45) Date of Patent: Mar. 17, 2020

(54) SANDAL STRAP REINFORCEMENT

(71) Applicants: Hongling Li, Guangzhou (CN); David K. Smith, Portland, OR (US)

(72) Inventors: Hongling Li, Guangzhou (CN); David K. Smith, Portland, OR (US)

(73) Assignee: GUANGZHOU COLORTECH NEW MATERIALS CO. LTD, Guangzhou (CN)

( * ) Notice: Subject to any disclaimer, the term of this patent is extended or adjusted under 35 U.S.C. 154(b) by 0 days.

(21) Appl. No.: 14/999,827

(22) Filed: Jul. 3, 2016

Related U.S. Application Data

(60) Provisional application No. 62/231,354, filed on Jul. 3, 2015.

(51) Int. Cl.
*A43B 3/12* (2006.01)
*A43B 13/12* (2006.01)

(52) U.S. Cl.
CPC ..... *A43B 3/122* (2013.01); *A43B 3/128* (2013.01); *A43B 13/127* (2013.01)

(58) Field of Classification Search
CPC ..... A43B 3/122; A43B 3/124; A43B 3/128; A43B 3/127
USPC ..... 36/11.5
See application file for complete search history.

(56) References Cited

U.S. PATENT DOCUMENTS

| | | | | |
|---|---|---|---|---|
| 3,978,596 | A * | 9/1976 | Brown | A43B 3/122 36/11.5 |
| 4,172,330 | A * | 10/1979 | Kao | A43B 3/103 36/101 |
| 4,817,302 | A * | 4/1989 | Saltsman | A43B 3/122 36/11.5 |
| 5,561,919 | A * | 10/1996 | Gill | A43B 3/12 36/11.5 |
| 6,637,130 | B2 | 10/2003 | Urie et al. | |
| 7,055,265 | B1 | 6/2006 | Barhum et al. | |
| 7,222,442 | B2 * | 5/2007 | Hillyer | A43B 3/103 36/10 |
| 7,762,011 | B2 | 7/2010 | Fuerst et al. | |
| 8,438,758 | B2 * | 5/2013 | Stonisch | A43B 3/12 36/100 |
| 8,448,351 | B2 | 5/2013 | Aveni | |
| 9,192,206 | B2 | 11/2015 | Yen | |
| 2003/0097722 | A1 * | 5/2003 | Tsai | A43B 3/122 12/142 S |
| 2008/0060227 | A1 * | 3/2008 | Enderson | A43B 3/103 36/100 |
| 2013/0160325 | A1 | 6/2013 | Moon | |
| 2013/0255105 | A1 | 10/2013 | Bishop et al. | |
| 2014/0352171 | A1 * | 12/2014 | Hillyer | A43B 3/0078 36/11.5 |
| 2015/0027004 | A1 | 1/2015 | Conrad et al. | |
| 2016/0007673 | A1 | 1/2016 | McDonald et al. | |

* cited by examiner

*Primary Examiner* — Timothy K Trieu

(57) ABSTRACT

A sandal strap reinforcement apparatus which is incorporated into a sandal having a multi-hardness midsole to reinforce the opening around the straps. The apparatus may be made of a molded material, fabric, tape, an o-ring, cord, or the same material as the harder layer. The apparatus is molded into the midsole and serves to protect the hole or slot from damage from a strap inserted through the hole or slot.

3 Claims, 6 Drawing Sheets

SANDAL STRAP REINFORCEMENT

CROSS-REFERENCE TO RELATED APPLICATION

This application claims priority to the U.S. Provisional Application No. 62/231,354, filed Jul. 3, 2015, and herein incorporated in its entirety by reference.

BACKGROUND

The sandals usually consist of a molded material insole on which a molded material midsole is attached and press fitted. Midsoles usually have projections and cut which couple respectively with the corresponding cuts and projections on the underlying outsole. Midsoles can be multi-layers with the top layer with softer material and the bottom layer with a harder material. Midsole usually consist of shock absorbing material, such Polyurethane or Ethylene-Vinyl Acetate (EVA), which have soft and flexible shock absorbing characteristics. The insole, if not present, will mean that the wearer's foot will come in directly in contact with the midsole. If this is the case, a multilayer midsole provides for improvement over a single layer midsole. The opposing sides of the sole edge have shaped projecting flaps with one or more slots for the passage of the straps which form the upper consisting of bands which hold the foot at the ankle and metatarsal area of the foot. Said straps may be made of fabric, leather, synthetic fabric or imitation leather or in any other suitable material.

The outsole which can be single or multilayer is the bottom of the sandal and it attaches to the midsole of the sandal. Because the outsole is the part of the sandal that comes into contact with the ground is made of harden and durable material. The midsoles are designed to provide cushioning and shock absorption.

For sandals with Polyurethane or EVA insoles or midsoles, the straps are usually made of leather, cloth, or plastic straps. With the typical sandal, the straps generally go through pre-punched openings in the sole and are held in place via cement, plugs or other method. The sandal has straps that enter the sole through several pre-punched or molded holes, some in the front of the sandal and several in the rear. The straps on the sandal will wear against the soft materials of the sole around the pre-punched or molded holes after several uses of the sandals. Also with straps around the outside of the sandal this too may also wear any soft material in the insole and midsole areas.

It is desirable to prevent or minimize the strap from wearing out the insole or midsole materials.

SUMMARY OF DISCLOSURE

An apparatus inserted into a sandal having a multi-durometer/hardness shoe midsole to reinforce the opening consisting of a slot, hole, or variation of a slot or hole. The apparatus may be made of a molded material, fabric, tape, an o-ring, cord, or the same material as the harder layer. The apparatus is molded into the midsole and serves to protect the hole or slot from damage from a strap inserted through the hole or slot.

A further objective is that the apparatus that may consist of a layer of fabric or laminate is sandwiched between two layers of midsole, the layers being of different hardness. The fabric may be between the two midsole layers only around the holes/slots or, covering the whole area between the two layers.

A further objective is that the apparatus will be part of the second layer of a two layer midsole, whereas the second layer being much higher hardness level than the top layer.

Another objective is a sandal with a midsole having a plurality of strap openings and consisting of more than one layer of material whereas the top layer material is made of softer material than the bottom layer, an outsole coupled to midsole, a plurality of straps that are inserted through strap openings (slots or holes) for attachment to the sandal, and an apparatus which consist of an insert through the top layer and consisting of durable material place within the strap openings.

LIST OF DRAWINGS

DESCRIPTION OF EMBODIMENTS

With reference to the above-listed drawings, this section describes particular embodiments and their detailed construction and operation. The embodiments described herein are set forth by way of illustration only and not limitation. Those skilled in the art will recognize in light of the teachings herein that there is a range of equivalents to the example embodiments described herein. Most notably, other embodiments are possible, variations can be made to the embodiments described herein, and there may be equivalents to the components, parts, or steps that make up the described embodiments.

As one skilled in the art will appreciate in light of this disclosure, certain embodiments are capable of achieving certain advantages over the known prior art, including some or all of the following: (1) less wear on the straps; (2) less wear of the top layer of a multi-layer midsole sandal or shoe to prevent damage to the midsole due to the straps; and (3) easily molded in the midsole. These and other advantages of various embodiments will be apparent upon reading the remainder of this section.

Figure 1:
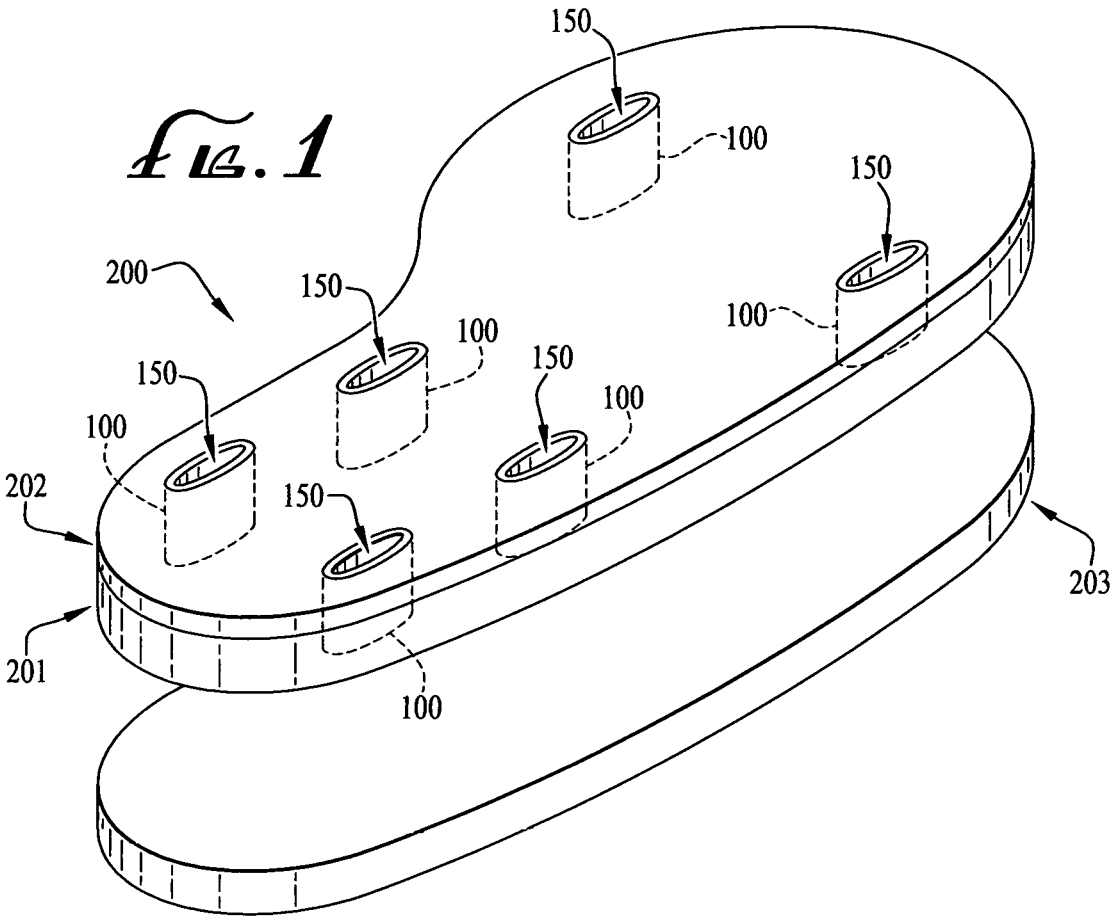
FIG. 1 is a isometric perspective view of the apparatus in multilayer sole.

FIG. 1 shows a general diagram of the preferred embodiment of the invention. The embodiment is made up of a multilayer midsole 200 and an outer sole 203 to form a sandal or similar type shoe. The straps are not shown. Midsole 200 is comprised of two layers, in this embodiment, layer 201 made of a harder material and layer 202 made from a softer material. This can be reversed with the top layer being harder and the bottom layer being softer. Apparatus 100, consisting of a molded sleeve or wrapped fabric or tape or an O-Ring is molded into midsole part 200 leaving several holes, or slots, 150. The apparatus 100 reinforces the area around the strap and provide other capabilities. The holes or slots, or openings will be referred as strap openings for insertion of the straps for the sandal or shoes. The slot 150 is large enough for a securing strap, or straps, to fit through the midsole. Apparatus 100 is intended to protect the material of the midsole so as to prevent the material from cracking or tearing. This will allow for the top midsole material to be made softer without concern for the material tearing, and to provide more cushion.

Figure 2A:
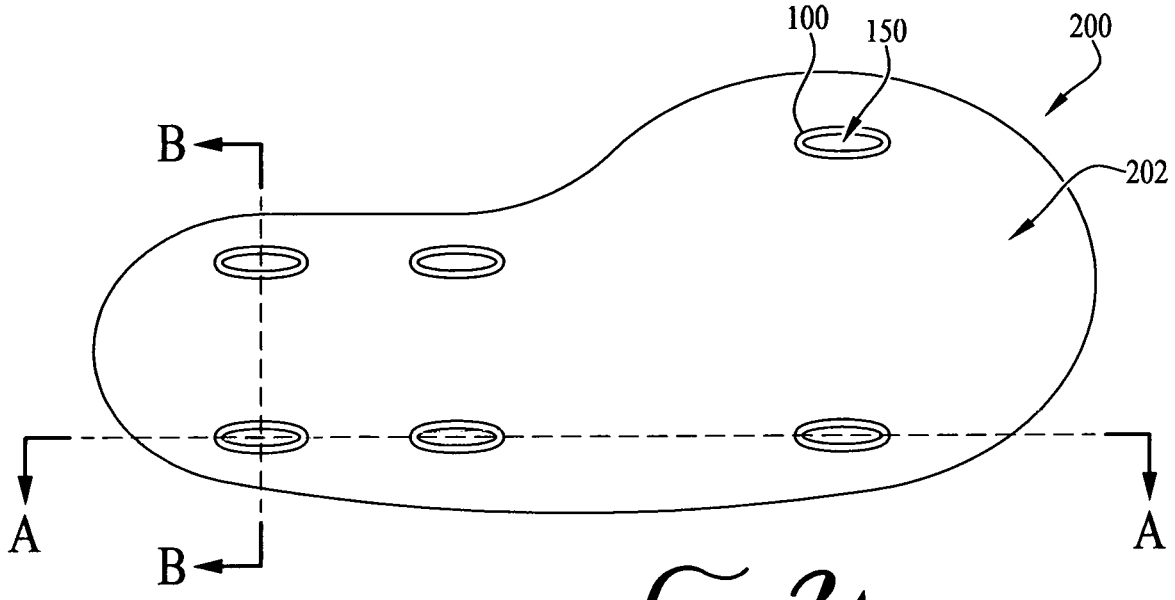
FIG. 2A is a top view of the apparatus in multilayer sole.

FIG. 2A shows a top view of midsole 200 with only layer 202 visible. Apparatus 100 and the slots 150 are visible. Additionally, lines A-A and B-B are shown and further illustrated in FIGS. 2B and 2C.

Figure 2B:
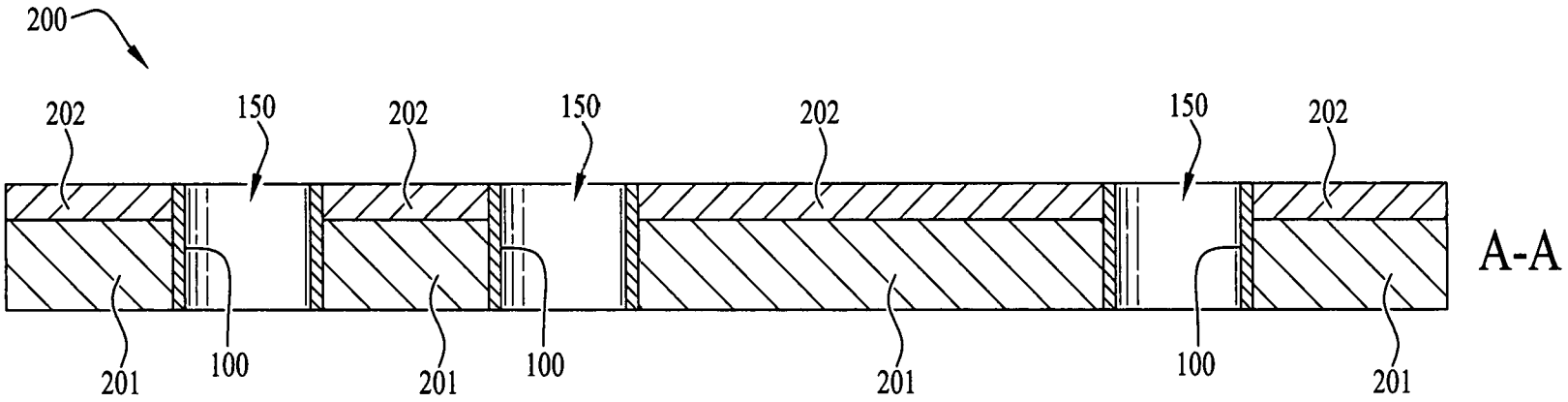
FIG. 2B is the cutout view of a lateral section of the apparatus in FIG. 2A.

FIG. 2B shows a cross section of line A-A, shown in FIG. 2A, of midsole 200 that presents apparatus 100 from the side view. In this instance, the height of apparatus 100 is the full height of midsole 200.

Figure 2C:
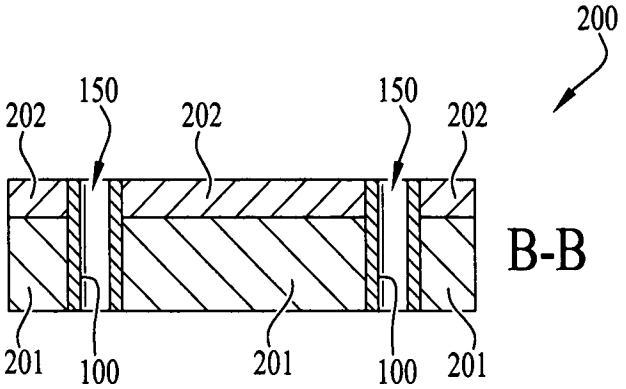
FIG. 2C is the cutout view of a longitudinal section of the apparatus in FIG. 2A.

FIG. 2C shows a cross section of line B-B, shown in FIG. 2A, on midsole 200 that presents a view of apparatus 100 from the back. In this instance also, the height of apparatus 100 is the full height of midsole 200.

Figure 3A:
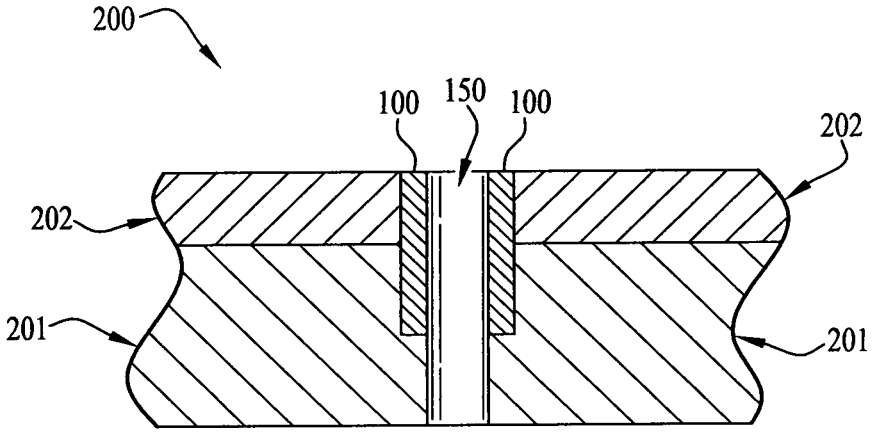
FIG. 3A is another cross section view from the rear showing the apparatus in another embodiment of a multi-layer sole.

FIG. 3A shows another cross section from the rear, showing midsole 200 with the medial and lateral walls of apparatus 100 visible and slot 150 clearly shown. In this instance, the height of apparatus 100 is shorter than that of midsole 200.

Figure 3B:
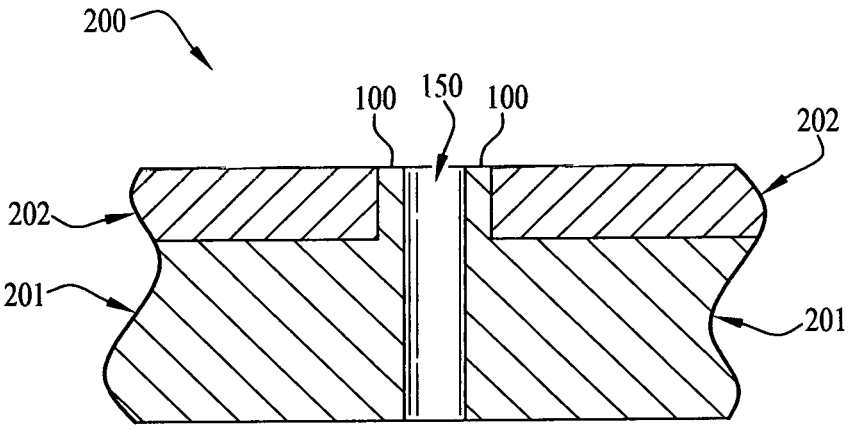
FIG. 3B is another cross section view from the rear showing the apparatus as part of second layer of a multilayer midsole.

FIG. 3B shows another cross section from the rear, showing the midsole 200 with apparatus 100 as part of the second layer 201. Apparatus 100 is made out the same material as layer 201 and part of the same mold. The top layer 202 is top layer of the multi-layer midsole. The advantage of this design is that no addition component is needed.

Figure 4:
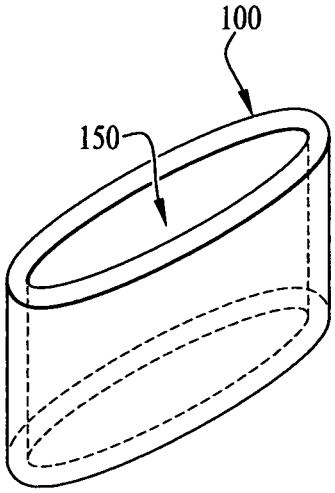
FIG. 4 is an isometric view of an embodiment of the apparatus shown as a sleeve.

FIG. 4 shows apparatus 100 in isolation. In this instance, apparatus 100 is a molded sleeve. The material for the molded sleeve is made of materials that is more durable than the top layer of the sole.

Figure 5:
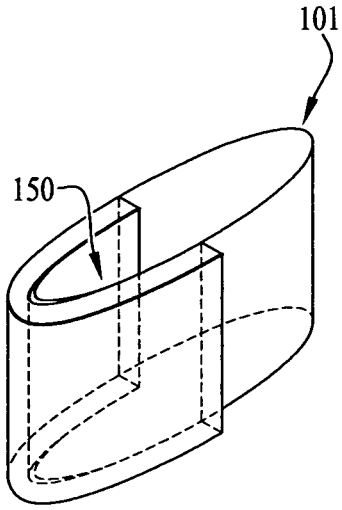
FIG. 5 is an isometric view of another embodiment of the apparatus shown as wrapped tape.

FIG. 5 shows an embodiment of the invention whereby the reinforcement is made from a wrapped tape or fabric as demonstrated with apparatus 101. In this illustration, the fabric/tape 101 has been wrapped counterclockwise and the finishing edge of the fabric/tape is shown on the outside of the reinforcement and the starting edge in shown inside slot 150.

Figure 6A:
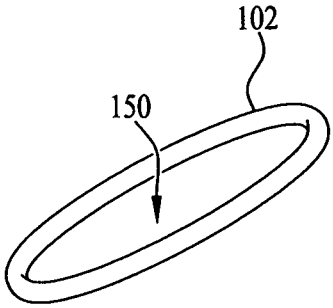
FIG. 6A is the isometric view of another embodiment of the apparatus shown as an O-ring configuration.
Figure 6B:
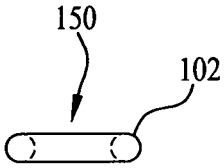
FIG. 6B is a side view of the embodiment of FIG. 6A.

The apparatus can also be produced with an O-ring as seen with apparatus 102 in FIGS. 6A and 6B.

Figure 7:
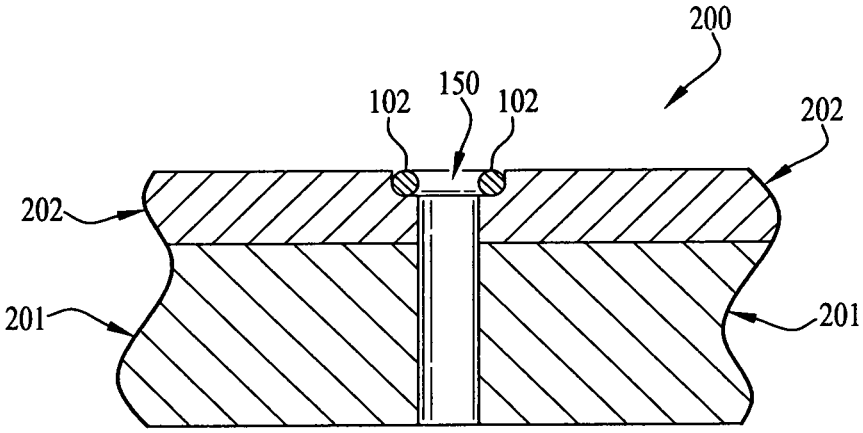
FIG. 7 is a side cutout view of the apparatus in an O-ring configuration in multilayer sole.

FIG. 7 shows a cross section of midsole 200 from the rear, illustrating layer 201 and layer 202 with apparatus 102 molded in place.

Figure 8:
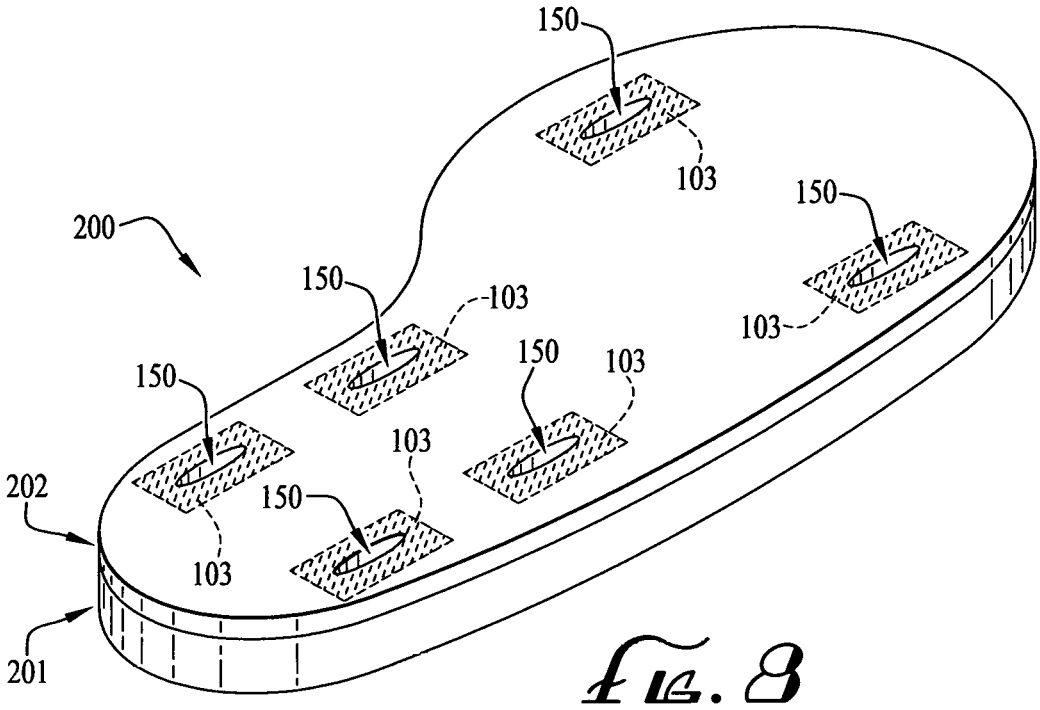
FIG. 8 is a isometric view of the apparatus in another embodiment in a multilayer sole.

In FIG. 8, another embodiment of the invention is shown whereby a thin fabric or laminate material is sandwiched in-between layer 201 and layer 202. In this embodiment, the apparatus 103 is only placed in the area immediately surrounding where slots 150 are located.

Figure 9:
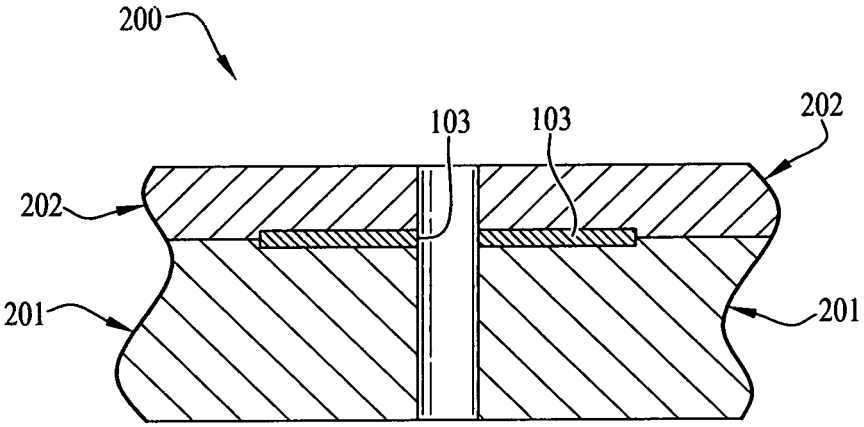
FIG. 9 is a side cutout view of the apparatus of FIG. 8.

FIG. 9 shows a cross-section of midsole 200 from the rear, illustrating apparatus 103 sandwiched between layer 201 and layer 202

Figure 10:
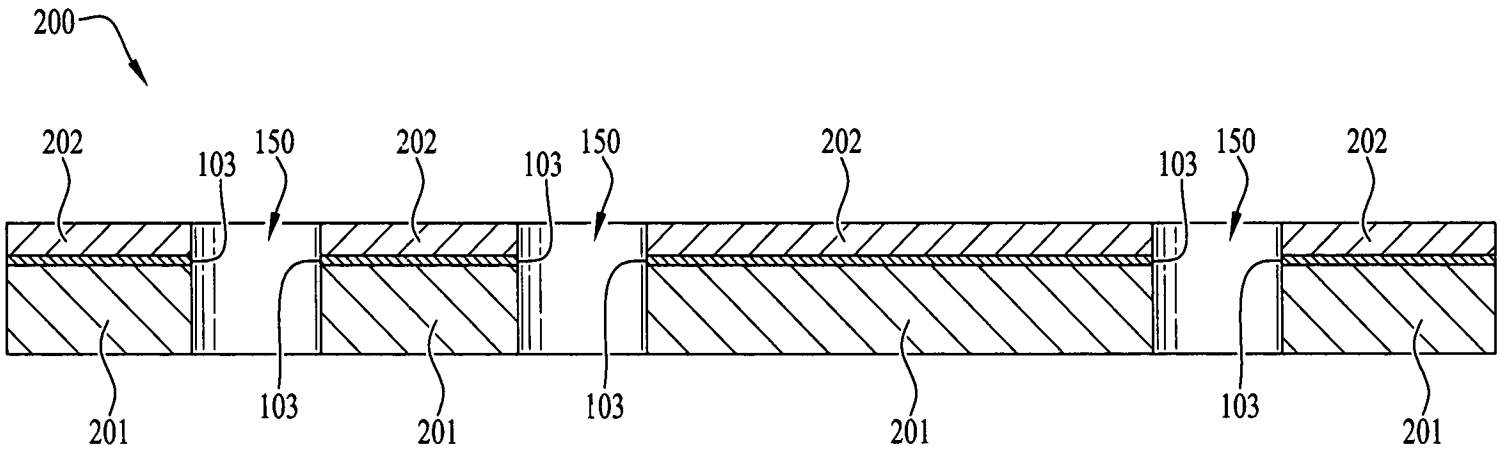
FIG. 10 is side view of another embodiment of the apparatus whereas the apparatus is between the multi-layer sole.

Another application of the invention is using a apparatus 103 that covers the full area between layer 201 and layer 202 as shown in FIG. 10.

The terms and descriptions used above are set forth by way of illustration only and are not meant as limitations. Those skilled in the art will recognize that those and many other variations, enhancements and modifications of the concepts described herein are possible without departing from the underlying principles of the invention. The scope of the invention should therefore be determined only by the following claims and their equivalents.

What is claim is:

1. A sandal comprising:

a midsole comprising more than one layers of material, including a top layer material and a bottom layer material, wherein the top layer material is made of softer material than the bottom layer material;

an outsole coupled to said midsole;

a plurality of strap openings in said midsole that straps are inserted through for attachment to said sandal; and a cylindrical insert for each strap opening, wherein the insert's height is the full height of said midsole and the strap goes through said insert, comprising material more durable than the top layer material, the cylindrical insert being molded into the midsole.

2. A sandal according to claim 1 wherein said cylindrical insert is a molded sleeve, or a section of tape.

3. A sandal according to claim 1 wherein said more durable material for said cylindrical insert is more resistant to cracking or tearing than the top layer of said multilayer midsole.

* * * * *